US006630788B1

(12) United States Patent
Park

(10) Patent No.: US 6,630,788 B1
(45) Date of Patent: Oct. 7, 2003

(54) PLASMA DISPLAY PANEL

(75) Inventor: Hun Gun Park, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/570,284

(22) Filed: May 12, 2000

(30) Foreign Application Priority Data

May 14, 1999 (KR) ..... 1999/17393
May 14, 1999 (KR) ..... 1999/17421
May 14, 1999 (KR) ..... 1999/17422
May 14, 1999 (KR) ..... 1999/17423

(51) Int. Cl.[7] ..... H01J 17/49
(52) U.S. Cl. ..... 313/582; 313/584
(58) Field of Search ..... 313/582, 583, 313/584, 585, 586, 587

(56) References Cited

U.S. PATENT DOCUMENTS 5,587,624 A * 12/1996 Komaki ..... 313/584
5,825,128 A * 10/1998 Betsui et al. ..... 313/582
6,034,657 A * 3/2000 Tokunaga et al. ..... 345/60
6,348,762 B1 * 2/2002 Nunomura et al. ..... 313/582

FOREIGN PATENT DOCUMENTS

JP 08-293260 11/1996
JP 09-050768 2/1997
JP 10-188819 7/1998
JP 10-092326 10/1998
KR 10-1998-005231 3/1998
KR 10-0229076 8/1999

* cited by examiner

*Primary Examiner*—Nishmeshkumar D. Patel
*Assistant Examiner*—Ken A Berck
(74) *Attorney, Agent, or Firm*—Fleshner & Kim, LLP

(57) ABSTRACT

A plasma display panel includes an address electrode formed in each discharge cell where a red phosphor, a green phosphor and a blue phosphor are formed, and a sustain electrode formed to cross the address electrode, having a first width in a discharge cell having the red phosphor, a second width in a discharge cell having the green phosphor, and a third width in a discharge cell having the blue phosphor. Since an aging voltage of the discharge cell having the green phosphor becomes lower by varying the sustain electrode, the address electrode, a dielectric film or an isolation wall, the probability to destroy insulation of the dielectric is reduced. Also, since the deviation between the aging voltages for emitting each discharge cell is reduced, a minimum value of the margin voltage stably showing white color becomes lower and a white colored voltage margin which is a common region of red, green, blue and white voltage regions increases, thereby broadening the control range of a circuit.

38 Claims, 15 Drawing Sheets

$W_1 = W_2 < W_3$

PLASMA DISPLAY PANEL

BACKGROUND OF THE INVENTION

1. Field of the Invention

The present invention relates to a flat display device, and ore particularly to a plasma display panel.

2. Background of the Related Art

Generally, a plasma display panel and a liquid crystal display (LCD) have lately attracted considerable attention as the most practical next generation display of flat panel displays. In particular, the plasma display panel has higher luminance and a wider visible angle than the LCD. For this reason, the plasma display panel is widely used as a thin type large display such as an outdoor advertising tower, a wall TV and a theater display.

FIG. 1*a* shows a structure of a related art plasma display panel of three-electrode area discharge type. As shown in FIG. 1*a*, the plasma display panel of three-electrode area discharge type includes an upper substrate 10 and a lower substrate 20 which are bonded opposite to each other. FIG. 1*b* shows a sectional structure of the plasma display panel of FIG. 1*a*, in which the lower substrate 20 is rotated by 90°.

The upper substrate 10 includes scan electrodes 16 and 16', sustain electrodes 17 and 17', a dielectric layer 11, and a passivation film 12. The scan electrodes 16 and 16'are formed in parallel to the sustain electrodes 17 and 17'. The dielectric layer 11 is deposited on the scan electrodes 16 and 16' and the sustain electrodes 17 and 17'.

The lower substrate 20 includes an address electrode 22, a dielectric film 21 formed on an entire surface of the substrate including the address electrode 22, an isolation wall 23 formed on the dielectric film 21 between the address electrodes, and a phosphor 24 formed on surfaces of the isolation wall 23 in each discharge cell and the dielectric film 21. Inert gases such as He and Xe are mixed in a space between the upper substrate 10 and the lower substrate 20 at a pressure of 300 to 700 Torr. The space is used as a discharge area.

The scan electrodes 16 and 16' and the sustain electrodes 17 and 17' include transparent electrodes 16 and 17 and bus electrodes 16' and 17' of metal so as to increase optical transmitivity of each discharge cell, as shown in FIGS. 2*a* and 2*b*. FIG. 2*a* is a plane view of the sustain electrodes 17 and 17' and the scan electrodes 16 and 16' and FIG. 2*b* is a sectional view thereof.

A discharge voltage from an externally provided driving integrated circuit (IC) is applied to the bus electrodes 16' and 17'. The discharge voltage applied to the bus electrodes 16' and 17' is applied to the transparent electrodes 16 and 17 to generate discharge between the adjacent transparent electrodes 16 and 17. The transparent electrodes 16 and 17 have an overall width of about 300 $\mu$m and are made of indium oxide or tin oxide. The bus electrodes 16' and 17' are formed of either three-layered thin film of Cr—Cu—Cr, or Ag. At this time, the bus electrodes 16' and 17' have a line width of ⅓ of a line width of the transparent electrodes 16 and 17.

The operation of the aforementioned AC plasma display panel of three-electrode area discharge type will be described with reference to FIGS. 3*a* to 3*d*.

If a driving voltage is applied between the address electrodes and the scan electrodes, opposite discharge occurs between the address electrodes and the scan electrodes, as shown in FIG. 3*a*. For this reason, some electrons discharged from the inert gas in the discharge cell come into collision with a surface of the passivation film, as shown in FIG. 3*b*. The collision of the electrons secondarily discharges electrons from the surface of the passivation film. The secondarily discharged electrons come into collision with a plasma gas to diffuse the discharge. If the opposite discharge between the address electrodes and the scan electrodes ends, wall charges having opposite polarities occur on the surface of the passivation film on the respective address electrodes and the scan electrodes, as shown in FIG. 3*c*.

If the discharge voltages having opposite polarities are continuously applied to the scan electrodes and the sustain electrodes and at the same time the driving voltage applied to the address electrodes is cut off, area discharge occurs in a discharge area on the surfaces of the dielectric layer and the passivation film due to potential difference between the scan electrodes and the sustain electrodes, as shown in FIG. 3*d*. The electrons in the discharge cell come into collision with the inert gas in the discharge cell due to the opposite discharge and the area discharge. As a result, the inert gas in the discharge cell is excited, and ultraviolet rays having a wavelength of 147 nm occur in the discharge cell. The ultraviolet rays come into collision with the phosphors surrounding the address electrodes and the isolation wall so that the plasma display panel is operated.

The process for fabricating the plasma display panel will be described.

As shown in FIG. 4*a*, an upper substrate and a lower substrate are respectively formed. As shown in FIG. 4*b*, the upper substrate and the lower substrate are bonded to each other and sealed along their edges. As shown in FIG. 4*c*, an exhaust pipe 50 is provided in the sealed substrate to exhaust air of the discharge space where the upper substrate and the lower substrate bonded to each other, so that the inert gas is implanted.

Afterwards, initial discharge is generated in the discharge cell where the inert gas is implanted, and aging process is performed to continuously discharge the discharge cell until the plasma display panel is stably operated. Tip off process is then performed to remove the exhaust pipe. Thus, the plasma display panel is completed.

To perform the aging process, an aging voltage is applied to each discharge cell. At this time, the aging voltage is higher than a normal operating voltage by 50V to 200V. Also, the greater the size of the panel is, the higher the aging voltage is.

Furthermore, as shown in FIG. 5, the aging voltage is varied depending on three phosphors of red, green and blue respectively formed in the discharge cell. Particularly, the aging voltage is the highest in the green phosphor. Thus, it is probably that insulation of the dielectric is destroyed.

The aging voltage showing red color, the aging voltage showing green color, and the aging voltage showing blue color are respectively different. Particularly, since the aging voltage showing white color is higher than the aging voltage showing the other colors, a proper voltage area for red, green, blue and white in a module becomes narrow. That is to say, if the same discharge voltage is applied to all the discharge cells, emitting time of the discharge cell having the green phosphor is later than emitting time the other discharge cells having the other colored phosphors. Accordingly, although the other phosphors are emitted, the green phosphor may not be emitted. Thus, the aging voltage showing white color should have the higher potential than that showing green color.

As described above, the related art plasma display panel has several problems.

The high aging voltage destroys insulation between the electrodes. This results in that the panel cannot be used. Also, since the redundancy of the operating voltage in the module is small, the module may be operated in error.

SUMMARY OF THE INVENTION

Accordingly, the present invention is directed to a plasma display panel that substantially obviates one or more of the problems due to limitations and disadvantages of the related art.

An object of the present invention is to provide a plasma display panel in which an aging voltage of a green cell having the highest aging voltage is lowered to prevent insulation of a dielectric from being destroyed, and deviation of the operating range of each discharge cell is reduced to increase redundancy of the operating voltage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel according to the first embodiment of the present invention includes an address electrode formed in each discharge cell where a red phosphor, a green phosphor and a blue phosphor are provided, and a sustain electrode formed to cross the address electrode, having a first width in a discharge cell having the red phosphor, a second width in a discharge cell having the green phosphor, and a third width in a discharge cell having the blue phosphor.

In another aspect, a plasma display panel according to the second embodiment of the present invention includes a first address electrode formed with a first width in a discharge cell having a red phosphor, a second address electrode formed with a second width in a discharge cell having a blue phosphor, and a third address electrode formed with a third width wider than the first width and the second width in a discharge cell having a green phosphor.

In other aspect, a plasma display panel according to the third embodiment of the present invention includes a first address electrode formed with a first width in a discharge cell having a red phosphor, a second address electrode formed with a second width in a discharge cell having a blue phosphor, a line formed with a third width in a discharge cell having a green phosphor, and a plurality of third address electrodes formed with a fourth width wider than the third width on some portion of the line at certain intervals.

In still another aspect, a plasma display panel according to the fourth embodiment of the present invention includes an address electrode respectively formed in each discharge cell having a red phosphor, a green phosphor and a blue phosphor, and a dielectric film deposited on the address electrode, having a first thickness in a discharge cell having the red phosphor, a second thickness in a discharge cell having the green phosphor, and a third thickness in a discharge cell having the blue phosphor.

In further still another aspect, a plasma display panel according to the fifth embodiment of the present invention includes a first isolation wall formed between a first address electrode in a discharge cell having a red phosphor and a second address electrode in a discharge cell having a blue phosphor, a second isolation wall formed between a third address electrode in a discharge cell having a green phosphor and the first address electrode at a first interval from the first isolation wall, and a third isolation wall formed between a fourth address electrode next to the third address electrode and the third address electrode at a second interval greater than the first interval from the second isolation wall.

In further still other aspect, a plasma display panel according to the sixth embodiment of the present invention includes a first isolation wall formed between a first address electrode in a first discharge cell having a red phosphor and a second address electrode in a second discharge cell having a blue phosphor, a second isolation wall formed between a third address electrode in a third discharge cell having a green phosphor and the first address electrode so that the first discharge cell protrudes and the third discharge cell is recessed, and a third isolation wall formed between a fourth address electrode next to the third address electrode and the third address electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1A:
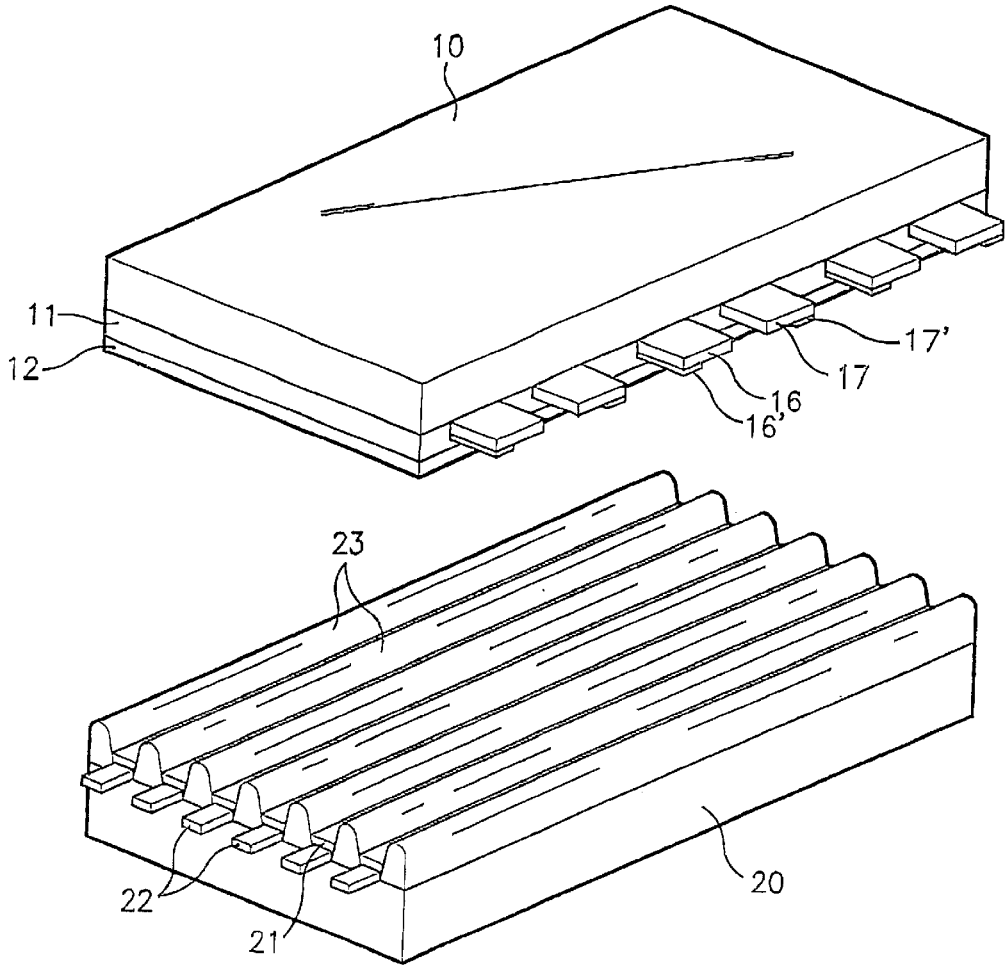
FIG.1A Related Art
FIG. 1*a* is a perspective view showing a related art plasma display panel.
Figure 1B:
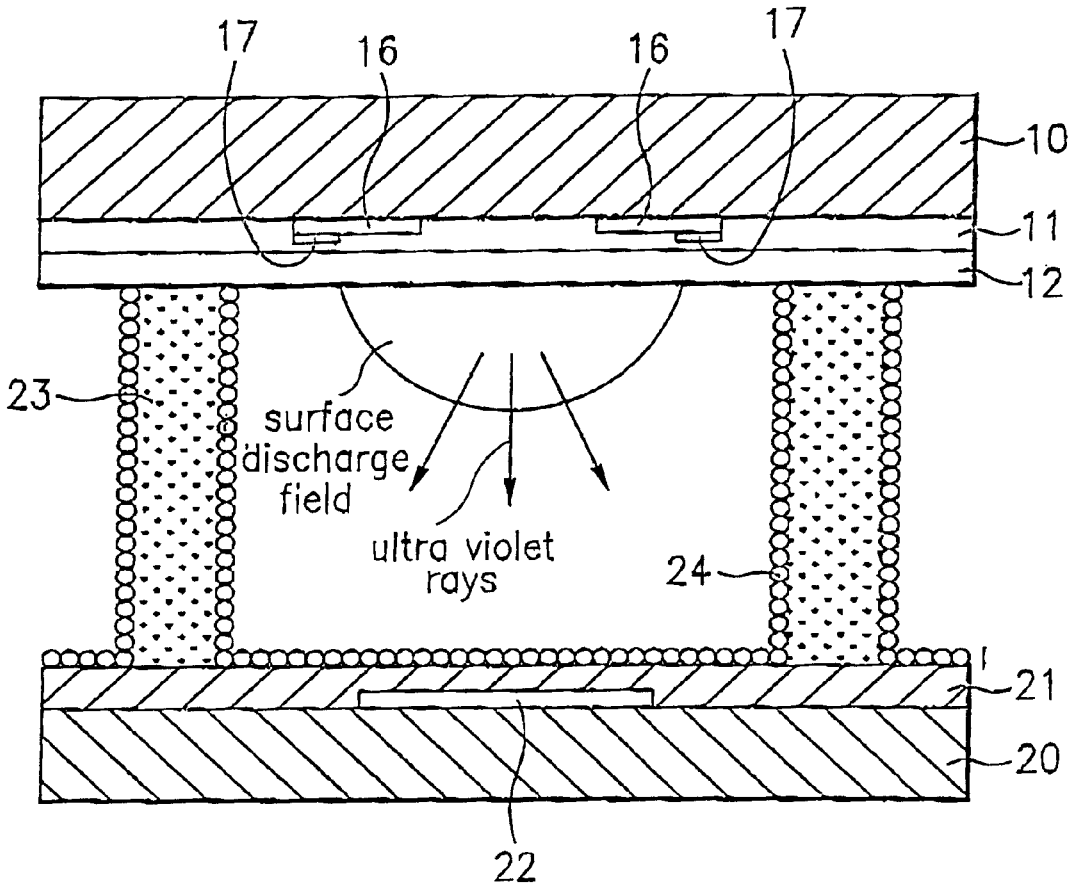
FIG.1B Related Art
FIG. 1*b* is a sectional view showing a structure of the plasma display panel of FIG. 1*a;*
Figure 2A:
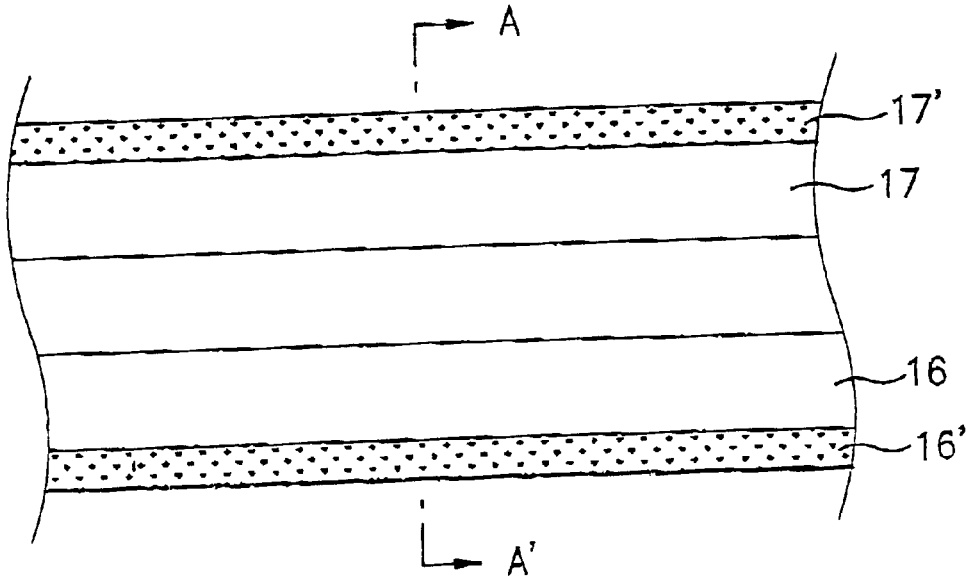
FIG.2A Related Art
FIG. 2*a* is a plane view showing a structure of a sustain electrode formed on an upper substrate.
Figure 2B:
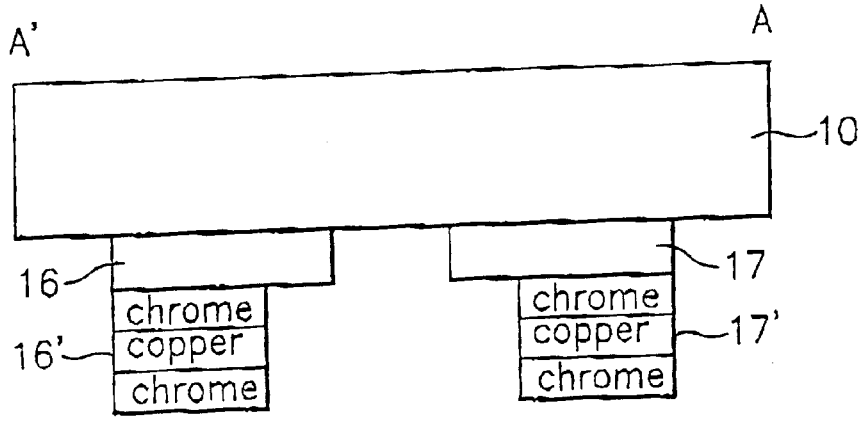
FIG.2B Related Art
FIG. 2*b* is a sectional view showing a structure of a sustain electrode formed on an upper substrate.
Figure 3A:
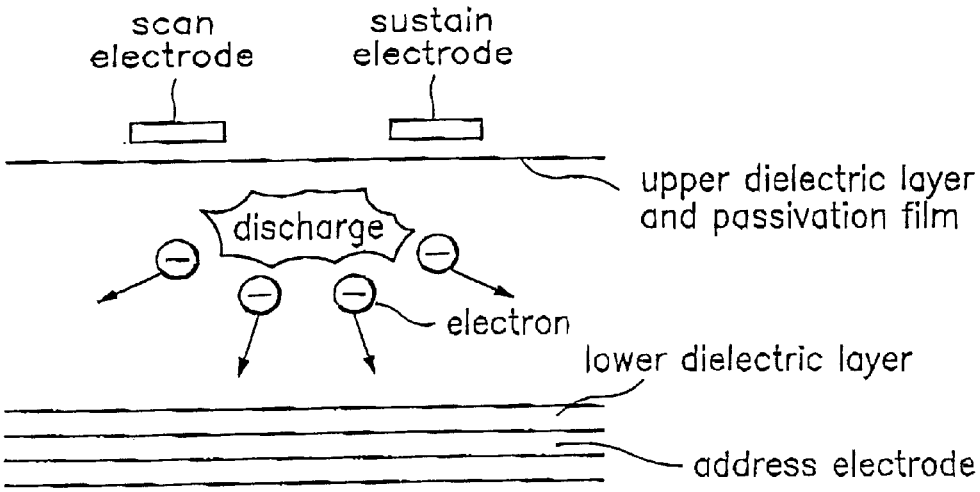
FIG.3A Related Art
FIGS. 3*a* to 3*d* show the operation of a discharge cell in a discharge area.
Figure 3B:
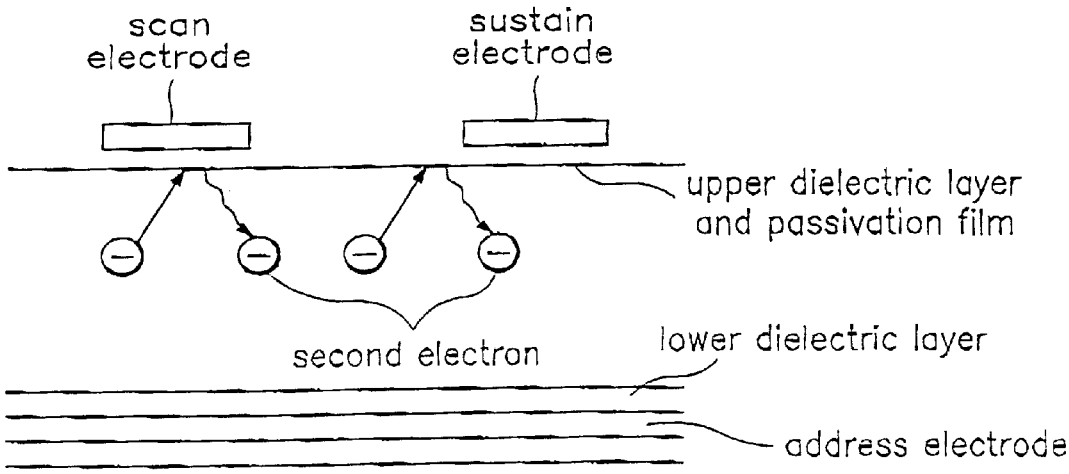
FIG.3B Related Art
Figure 3C:
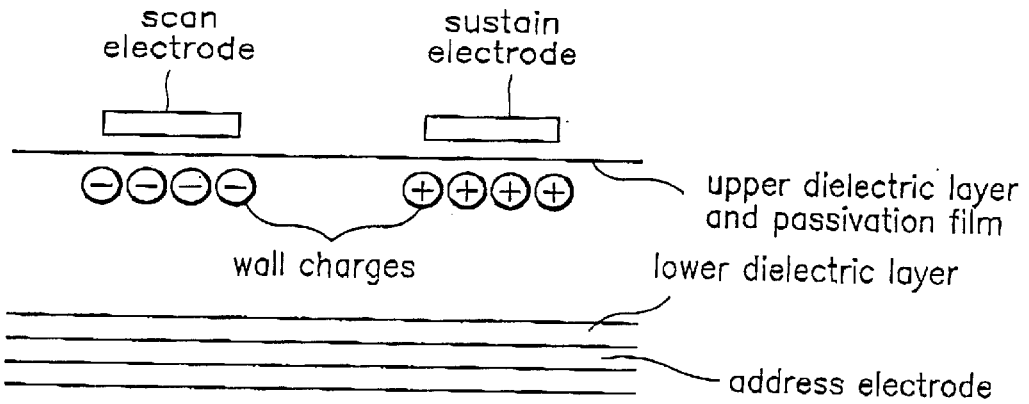
FIG.3C Related Art
Figure 3D:
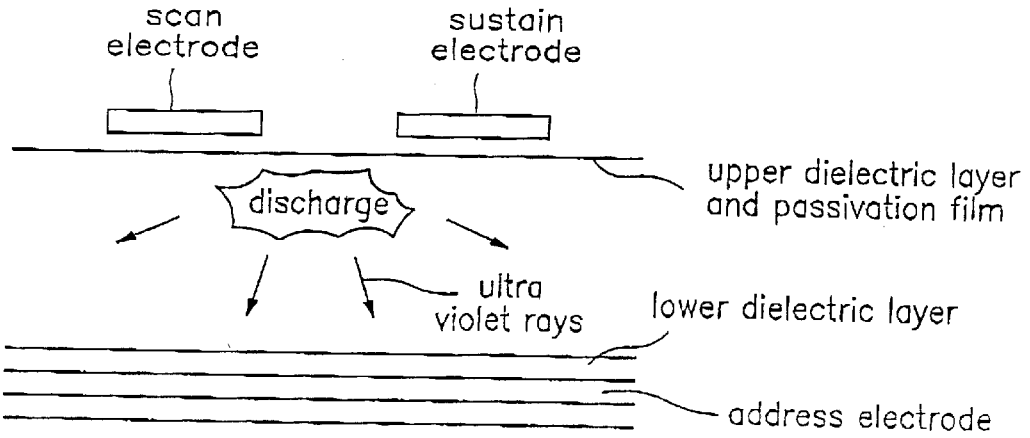
FIG.3D Related Art
Figure 4A:
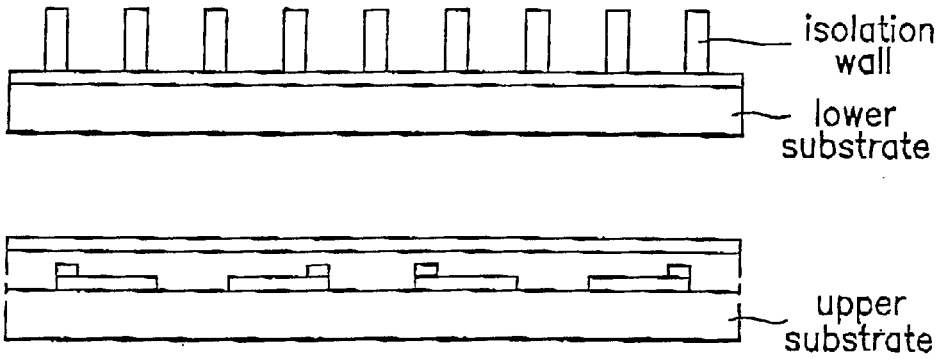
FIG.4A Related Art
FIGS. 4*a* to 4*c* show the process for a general plasma display panel.
Figure 4B:
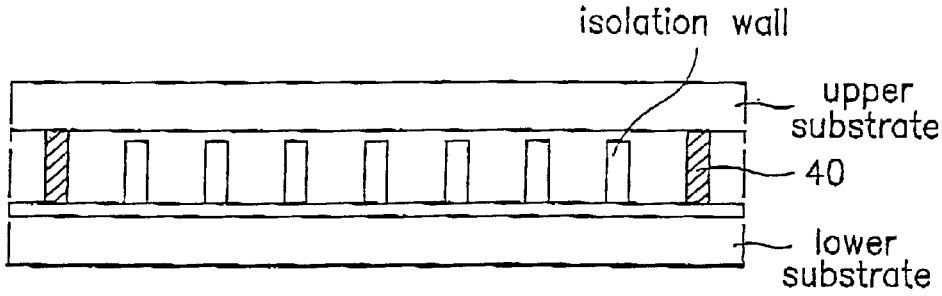
FIG.4B Related Art
Figure 4C:
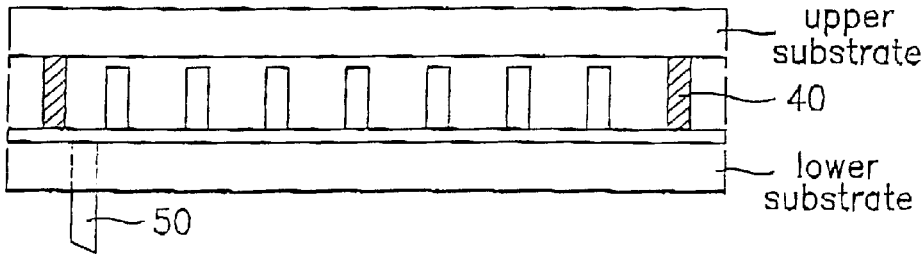
FIG.4C Related Art
Figure 5:
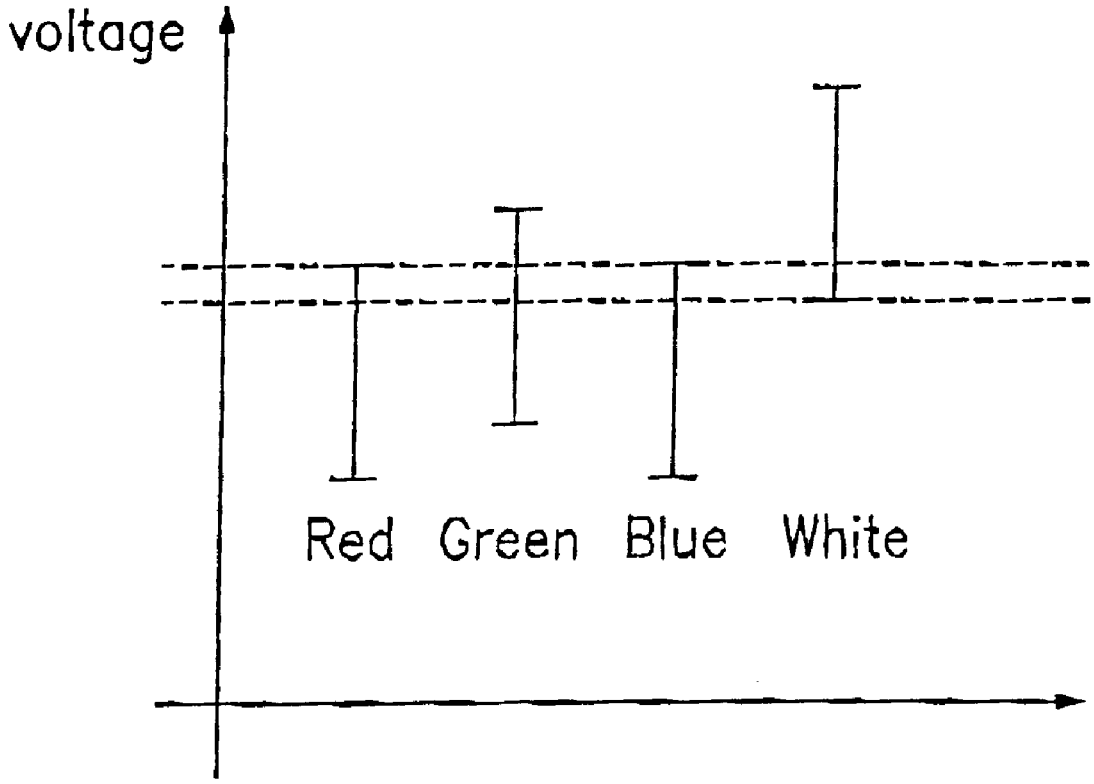
FIG.5 Related Art
FIG. 5 is a graph showing control range of an aging voltage applied during fabricating the related art plasma display panel.

Reference will now be made in detail to the preferred embodiments of the present invention, examples of which are illustrated in the accompanying drawings.

A plasma display panel according to the first to sixth embodiments of the present invention will be described with reference to FIG. 6*a* to FIG. 13.

First Embodiment

A plasma display panel according to the first embodiment of the present invention will be described with reference to FIGS. 6*a* to 6*c*.

Address electrodes 101, 102 and 103 are formed on a lower substrate (not shown) at certain intervals, and an isolation wall 110 is formed between the address electrodes 101 and 102 and between the address electrodes 102 and 103 to form a discharge cell of a certain size. The address electrodes 101, 102 and 103 and the isolation wall 110 are identical to those of the related plasma display panel and thus their detailed description will be omitted.

Sustain electrodes 120 and 120' which are main elements of the present invention are formed at irregular widths. Particularly, widths of the sustain electrodes 120 and 120' corresponding to a discharge cell having a green phosphor are wider than widths of portions corresponding to the other discharge cells having the other colored phosphors. Widths of the sustain electrodes 120 and 120' in a discharge cell having a green phosphor are narrow, preferably within the range of 1.25 times of the narrowest width of the discharge cells having the other colored phosphors.

At this time, the widths of the sustain electrodes 120 and 120' in the discharge cell having the red phosphor are different from those of the sustain electrodes 120 and 120' in the discharge cell having the blue phosphor. However, the widths of the sustain electrodes 120 and 120' in the discharge cell having the red phosphor may be the same as those of the sustain electrodes 120 and 120' in the discharge cell having the blue phosphor.

In other words, the plasma display panel of the present invention includes a pair of sustain electrodes 120 and 120' formed in each discharge cell to cross the address electrodes 101, 102 and 103, and projection portions 122, 122', 123 and 123' projected in some portions of the sustain electrodes 120 and 120' formed in the green phosphor, at certain widths.

Figure 6A:
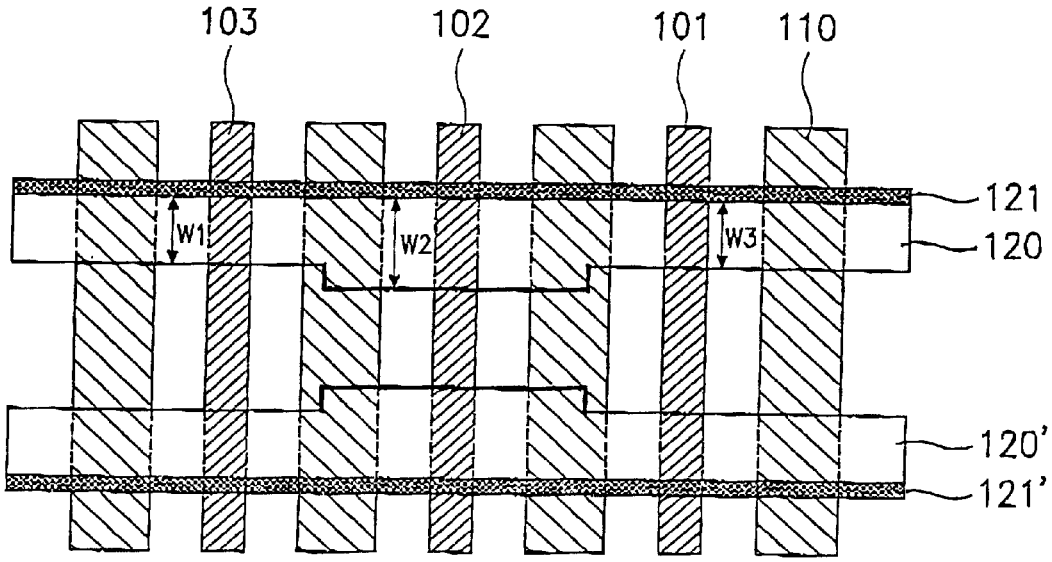
FIGS. 6*a* to 6*c* show a structure of a plasma display panel according to the first embodiment of the present invention.
Figure 6B:
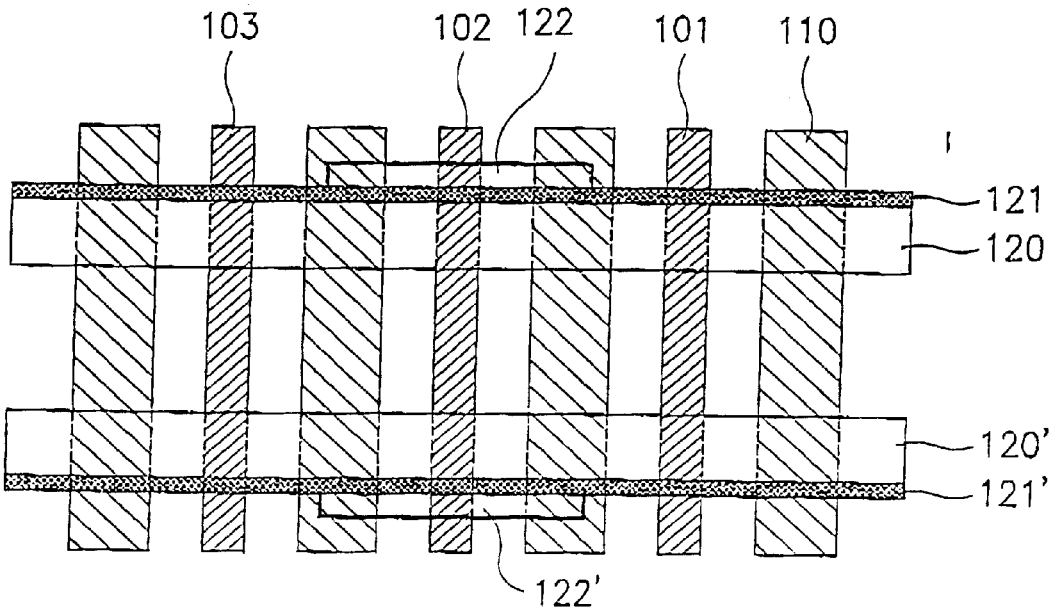
Figure 6C:
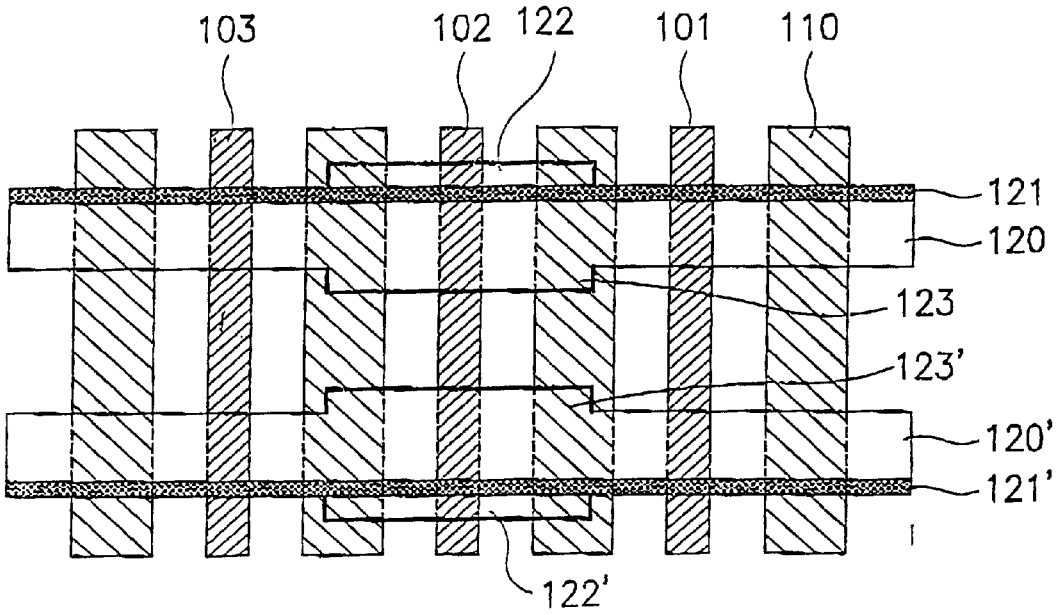

The projection portions may face each other toward the center of the discharge area where the address electrodes 101, 102 and 103 cross the pair of sustain electrodes 120 and 120', as shown in FIG. 6*a*. As shown in FIG. 6*b*, the projection portions may be formed to face each other toward the outer direction of the discharge area. Also, as shown in FIG. 6*c*, the projection portions may be formed in parallel to each other. As a result, the widths of the sustain electrodes 120 and 120' in the discharge cell having the green phosphor become wider than the widths of the sustain electrodes 120 and 120' in the discharge cell having the other phosphor.

At this time, the projection widths of the projection portions 122, 122', 123 and 123' are preferably within the range of 30% of the widths of the sustain electrodes 120 and 120'.

If the widths of the sustain electrodes 120 and 120' in the discharge cell having the green phosphor become wider than the widths of the sustain electrodes 120 and 120' in the discharge cell having the other phosphor, more charge particles occur in the discharge cell having the green phosphor by the discharge voltage applied through the bus electrodes 121 and 121'. Accordingly, priming effect of the discharge cell having the green phosphor becomes higher than the discharge cell having the other phosphor. As a result, if the same discharge voltage is applied to all the discharge cells, electric field of the discharge cell having the green phosphor becomes higher than electric field of the discharge cell having the other phosphor, thereby increasing emission rate of the green phosphor.

Second Embodiment

Figure 7:
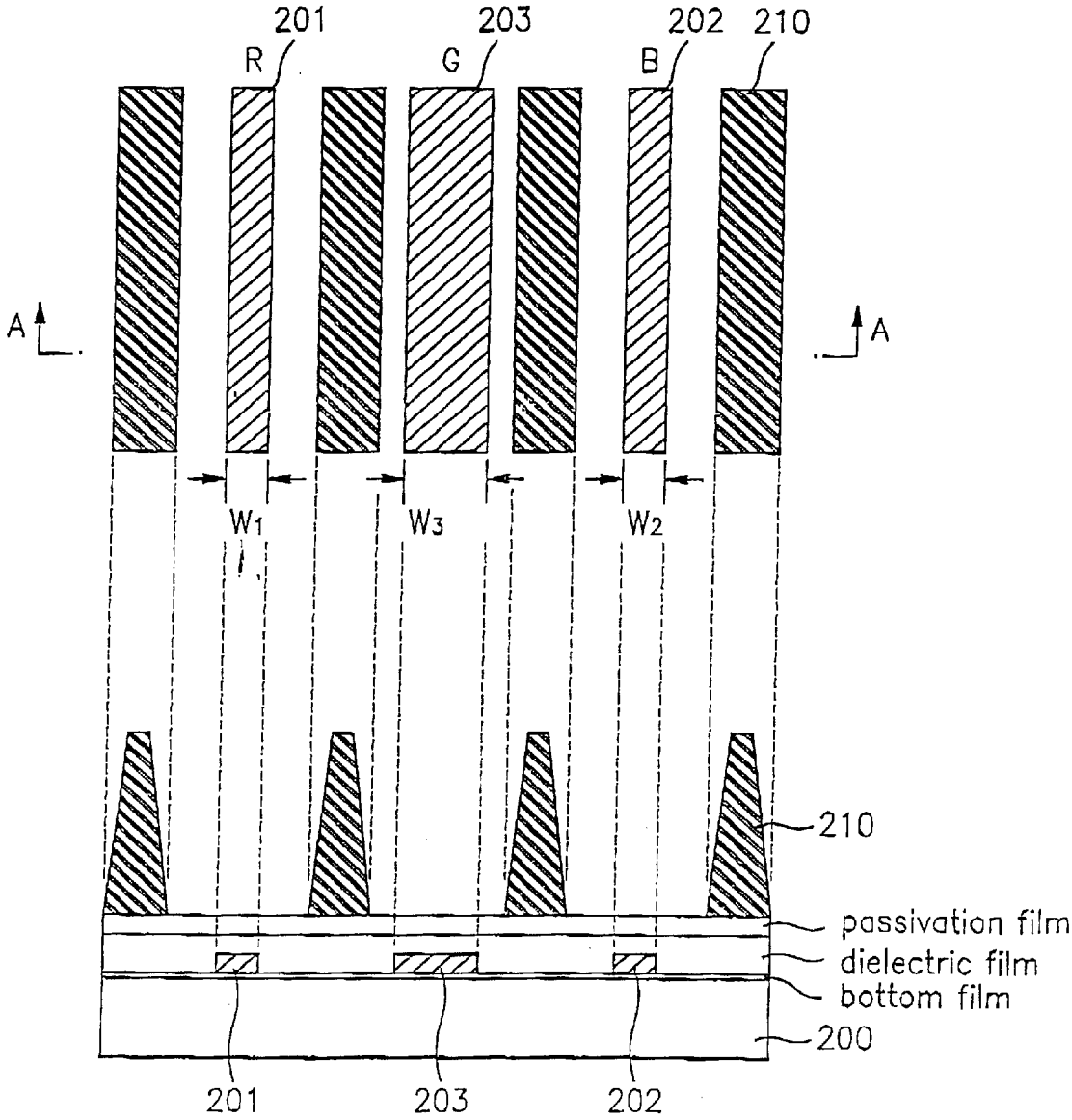
FIG. 7 shows a structure of a plasma display panel according to the second embodiment of the present invention.

A plasma display panel according to the second embodiment of the present invention will be described with reference to FIG. 7.

In the plasma display panel according to the second embodiment of the present invention, a first address electrode 201 is formed in a discharge cell having a red phosphor in a lower substrate 200. A second address electrode 202 is formed in a discharge cell having a blue phosphor, and a third address electrode 203 is formed in a discharge cell having a green phosphor. The third address electrode 203 is wider than the other address electrodes having the other phosphors. The respective discharge cells are separated by the isolation wall 210.

At this time, the first address electrode 201 and the second address electrode 202 may have the same size or different sizes. However, the third address electrode 203 should be wider than the other address electrodes.

The operation of the plasma display panel according to the present invention will be described.

If the discharge voltage is applied to each address electrode (not shown), discharge occurs between a sustain electrode (not shown) and each address electrode.

At this time, more charge particles are formed in the discharge cell, where the third address electrode 203 is formed, than the discharge cell where the first and second address electrodes 201 and 202 are formed. This is the reason why that the third address electrode 203 is wider than the first address electrode 201 and the second address electrode 202.

If the width of the electrode is wide, an electric field forming region becomes wider. Thus, the amount of the charge particles occurred in the same voltage becomes much. Accordingly, priming effect of the discharge cell having the green phosphor becomes higher than the discharge cell having the other phosphor. As a result, if the same discharge voltage is applied to all the discharge cells, electric field of the discharge cell having the green phosphor becomes higher than electric field of the discharge cell having the other phosphor, thereby increasing emission rate of the green phosphor.

Third Embodiment

Figure 8:
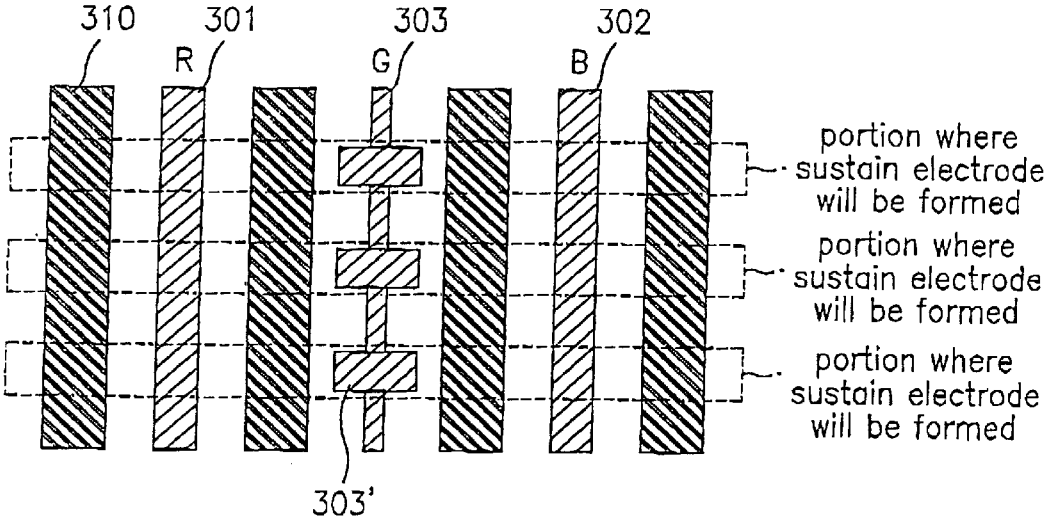
FIG. 8 shows a structure of a plasma display panel according to the third embodiment of the present invention.

A plasma display panel according to the third embodiment of the present invention will be described with reference to FIG. 8.

In the plasma display panel according to the third embodiment of the present invention, a third address electrode 303 includes a line having a certain width and a plurality of electrodes 303' formed on some portion of the line at certain intervals to be wider than the line. In other words, the electrodes 303' are formed on the line 303 having a smaller width than the first and second address electrodes 301 and 302 to be wider than the line 303. At this time, each electrode on the line is wider than the first address electrode 301 and the second address electrode 302. Particularly, it is preferable that each electrode on the line is formed on a portion where the sustain electrode of the upper substrate crosses the line, as shown in FIG. 8.

The operation of the plasma display panel according to the third embodiment of the present invention will be described.

Electric field is formed between each electrode formed on the line of the third address electrode 303 and the sustain electrode of the upper substrate by the discharge voltage applied to the third address electrode 303. Thus, discharge occurs in the discharge cell having the green phosphor.

At this time, since each electrode formed on the line of the third address electrode 303 is wider than the first and second address electrodes, more charge particles are formed in the discharge cell, where the line of the third address electrode 303 is formed, than the discharge cell where the other address electrodes are formed. Accordingly, priming effect of the discharge cell having the green phosphor becomes higher than the discharge cell having the other phosphor. As a result, if the same discharge voltage is applied to all the discharge cells, electric field of the discharge cell having the green phosphor becomes higher than electric field of the discharge cell having the other phosphor, thereby increasing emission rate of the green phosphor.

Fourth Embodiment

Figure 9:
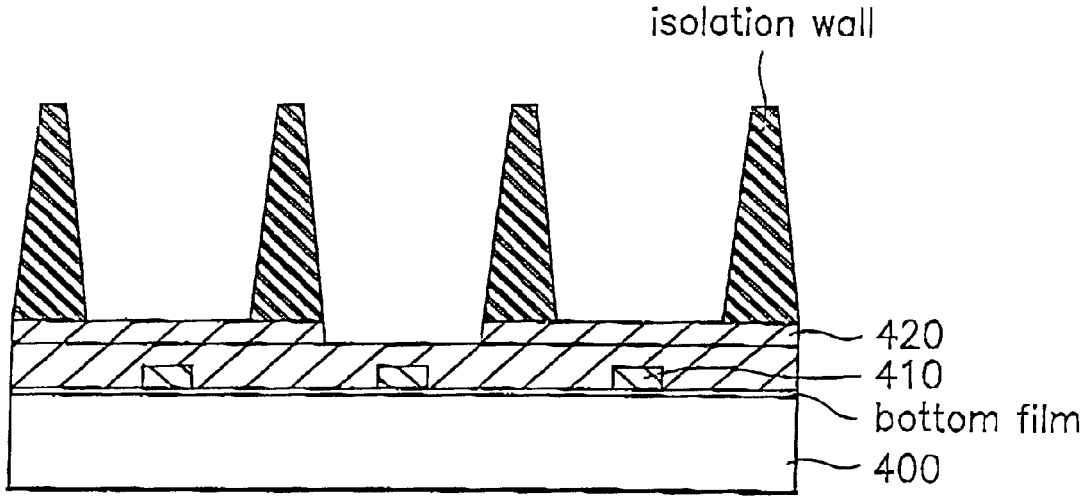
FIG. 9 shows a structure of a plasma display panel according to the fourth embodiment of the present invention.

A plasma display panel according to the fourth embodiment of the present invention will be described with reference to FIG. 9.

The plasma display panel according to the fourth embodiment of the present invention includes an address electrode 410 respectively formed in each discharge cell having a red phosphor, a green phosphor and a blue phosphor, and a dielectric film 420 deposited on the address electrode 410, having a first thickness in a discharge cell having the red phosphor, a second thickness in a discharge cell having the green phosphor, and a third thickness in a discharge cell having the blue phosphor.

The address electrode 410 is formed on a lower substrate 400 of the plasma display panel at a certain interval and its structure is identical to that of the related plasma display panel.

The dielectric film 420 which is deposited on the address electrode 410 is formed in a discharge cell having the highest aging voltage at the thinnest thickness. In other words, among all the discharge cells of the plasma display panel, since the discharge cell having the highest aging voltage is the discharge cell having the green phosphor, the dielectric film 420 of the present invention is formed in the discharge cell having the green phosphor at the thinnest thickness.

At this time, the dielectric film of the discharge cell having the blue phosphor and the dielectric film of the discharge cell having the red phosphor are preferably formed at the same thickness. However, they may be formed at different thicknesses.

Furthermore, the dielectric film of the present invention may be formed on the lower substrate 400 at a certain thickness so as to form a first dielectric film which is deposited on the address electrodes 410 and a second dielectric film which is formed on only the first dielectric film of the discharge cells having the red phosphor and the blue phosphor.

In other words, since the second dielectric film is not formed in the discharge cell having the green phosphor unlike the other discharge cell having the other phosphor, the dielectric film on the address electrode 410 becomes thinner than the other discharge cell having the other phosphor.

The operation of the plasma display panel according to the present invention will be described.

If the discharge voltage is applied to each address electrode 410 on the lower substrate 400, discharge occurs between a sustain electrode (not shown) and each address electrode.

At this time, more charge particles are formed in the discharge cell, where the address electrode deposited with the dielectric film having only the second thickness is formed, than the discharge cell where the address electrode having the first and second thicknesses is formed. This is the reason why that a capacitance value of each discharge cell is varied depending on the thickness of the dielectric film 420, thereby resulting in that electric field of each discharge cell is also varied depending on the thickness of the dielectric film 420.

In a state that the same voltage is applied to the address electrode 410, the electric field becomes lower as the dielectric film 420 becomes thicker, thereby increasing the amount of charge particles. In the plasma display panel of the present invention, since the dielectric film of the discharge cell having the green phosphor has the thinnest thickness, the electric field of the discharge cell having the green phosphor is higher than that of the discharge cell having the other phosphor. Accordingly, priming effect of the discharge cell having the green phosphor becomes higher than the discharge cell having the other phosphor. As a result, if the same discharge voltage is applied to all the discharge cells, the electric field of the discharge cell having the green phosphor becomes higher than that of the discharge cell having the other phosphor, thereby increasing emission rate of the green phosphor.

Fifth Embodiment

Figure 10:
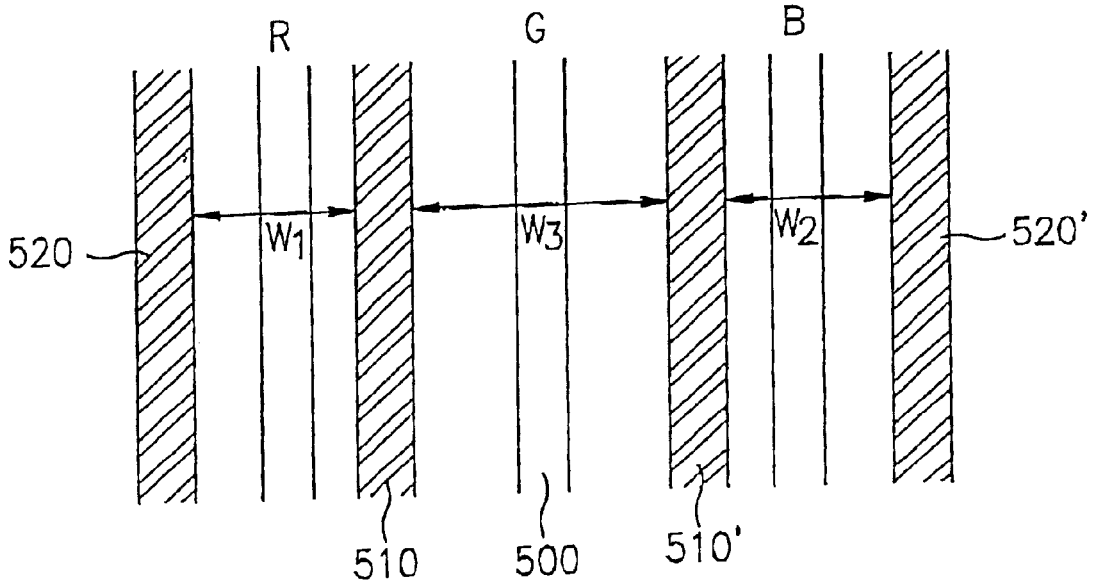
FIG. 10 shows a structure of a plasma display panel according to the fifth embodiment of the present invention.

A plasma display panel according to the fifth embodiment of the present invention will be described with reference to FIG. 10.

In the plasma display panel according to the fifth embodiment of the present invention, an isolation wall is identical to the related art isolation wall except that the isolation wall is formed so that the discharge cell having the green phosphor is wider than the discharge cell having the other phosphor.

In other words, the discharge cell having the red phosphor includes a first isolation wall 520 and a second isolation wall 510. The first and second isolation walls 520 and 510 are spaced apart from each other at a first predetermined width W1. The discharge cell having the blue phosphor includes a third isolation wall 510' and a fourth isolation wall 520'. The third and fourth isolation walls 510' and 520' are spaced apart from each other at a second predetermined width W2. At this time, the first width W1 and the second width W2 may be formed at the same size.

Meanwhile, the discharge cell having the green phosphor includes a second isolation wall 510 and a third isolation wall 510'. The distance between the second isolation wall 510 and the third isolation wall 510' has a third width W3 wider than the first width W1 and the second width W2. In other words, the discharge cell having the green phosphor is wider than the discharge cell having the other phosphor. At this time, it is preferable that a width ratio of the discharge cell having the green phosphor and the discharge cell having the other phosphor, that is, a ratio of the first width W1 and the third width W3 or a ratio of the second width W2 and the third width W3 is 0.5:1 to 0.9:1.

The operation of the plasma display panel according to the resent invention will be described.

If the discharge voltage is applied to each address electrode 500 on the lower substrate, discharge occurs between a sustain electrode (not shown) and each address electrode 500.

At this time, more charge particles are formed in the discharge cell having the third width W3 than the discharge cell having the first width W1 and the second width W2. That is to say, in a state that the same voltage is applied to the address electrode 510, electric field becomes lower as the discharge cell has a small width while electric field becomes higher as the discharge cell has a wide width, thereby increasing charge particles.

In the plasma display panel of the present invention, since the discharge cell having the green phosphor is the widest, the electric field of the discharge cell having the green phosphor is higher than that of the discharge cell having the other phosphor. Accordingly, priming effect of the discharge cell having the green phosphor becomes higher than the discharge cell having the other phosphor. As a result, if the same discharge voltage is applied to all the discharge cells, the electric field of the discharge cell having the green phosphor becomes higher than that of the discharge cell having the other phosphor, thereby increasing emission rate of the green phosphor.

Sixth Embodiment

A plasma display panel according to the sixth embodiment of the present invention will be described with reference to FIGS. 11 and 12.

Figure 11:
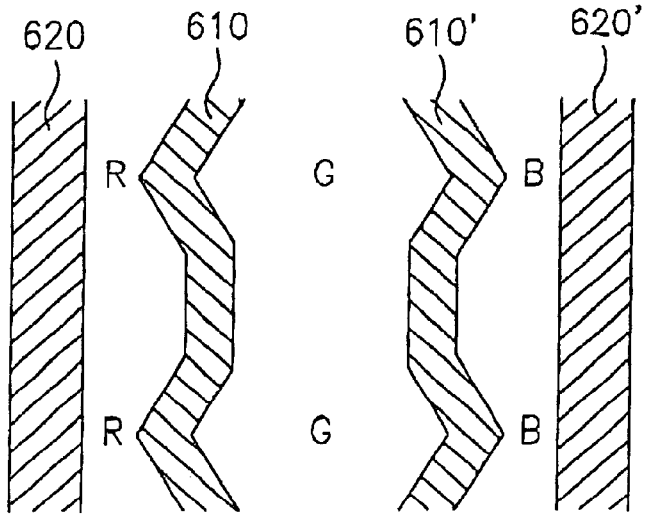
FIG. 11 shows a structure of a plasma display panel according to the sixth embodiment of the present invention.
Figure 12:
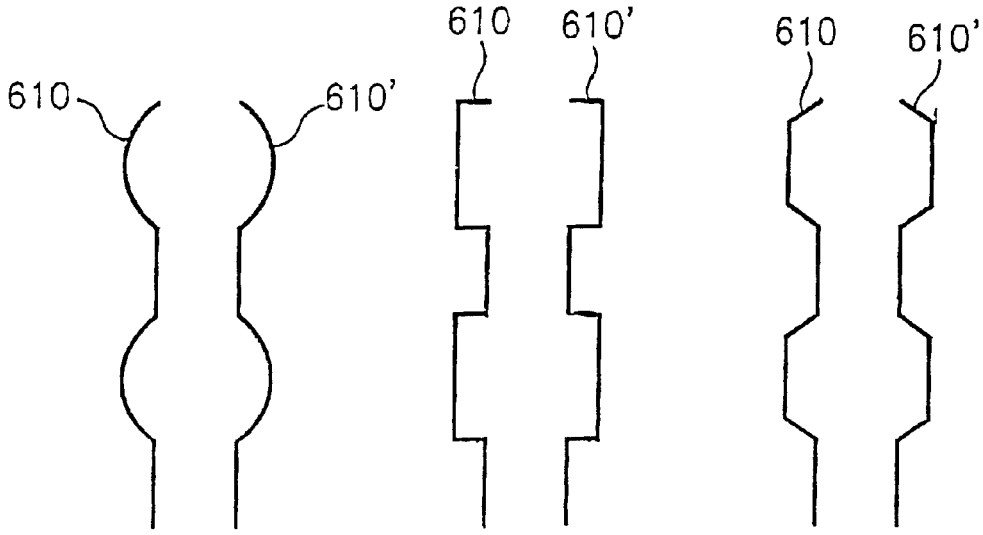
FIG. 12 shows various isolation walls applicable to the sixth embodiment of the present invention.

In the plasma display panel according to the sixth embodiment of the present invention, as shown in FIG. 11, an isolation wall may be varied to widen the width of the discharge cell having the green phosphor.

Referring to FIG. 11, the plasma display panel includes a first isolation wall 620 formed between a first address electrode in a first discharge cell having a red phosphor and a second address electrode in a second discharge cell having a blue phosphor, a second isolation wall 610 formed between a third address electrode in a third discharge cell having a green phosphor and the first address electrode so that the first discharge cell protrudes and the third discharge cell is recessed, and a third isolation wall 610' formed between a fourth address electrode next to the third address electrode and the third address electrode.

First, the first isolation wall 620 is identical to the isolation wall of the related art plasma display panel. That is, the isolation wall formed between the discharge cell having the blue phosphor and the discharge cell having the red phosphor has the same shapes.

The second isolation wall 610 has a different shape from the first isolation wall 620 and the fourth isolation wall 620'. In other words, the second isolation wall 610 has a zig-zag shape to form a projection portion and a recess portion. At this time, the projection portion of the second isolation wall 610 is formed in the discharge cell having the red phosphor and the discharge cell having the blue phosphor. The recess portion of the second isolation wall 610 is formed in the discharge cell having the green phosphor. As a result, the discharge cell having the green phosphor becomes wider than the discharge cell having the other phosphor.

Preferably, the projection portion and the recess portion are formed so that the third isolation wall 610' is symmetrical to the second isolation wall 610. The projection portion of the third isolation wall 610' is formed in the discharge cell having the red phosphor or the discharge cell having the blue phosphor. The recess portion of the third isolation wall 610' is formed in the discharge cell having the green phosphor.

As a result, the discharge cell having the green phosphor becomes wider than the discharge cell having the other phosphor.

The operation of the plasma display panel according to the present invention will be described.

If the discharge voltage is applied to each address electrode 600 on the lower substrate, discharge occurs between a sustain electrode (not shown) and each address electrode 600.

At this time, more charge particles are formed in the discharge cell having the green phosphor than the discharge cell having the red phosphor and the discharge cell having the blue phosphor. That is to say, in a state that the same voltage is applied to the address electrode 610, electric field becomes lower as the discharge cell has a smaller width while electric field becomes higher as the discharge cell has a wider width, thereby increasing charge particles. The reason why is that the discharge cell having the green phosphor is wider than the discharge cell having the other phosphor due to the recess and projection portions in a zig-zag form.

Accordingly, priming effect of the discharge cell having the green phosphor becomes higher than the discharge cell having the other phosphor. As a result, if the same discharge voltage is applied to all the discharge cells, the electric field of the discharge cell having the green phosphor becomes higher than that of the discharge cell having the other phosphor, thereby increasing emission rate of the green phosphor.

Figure 13:
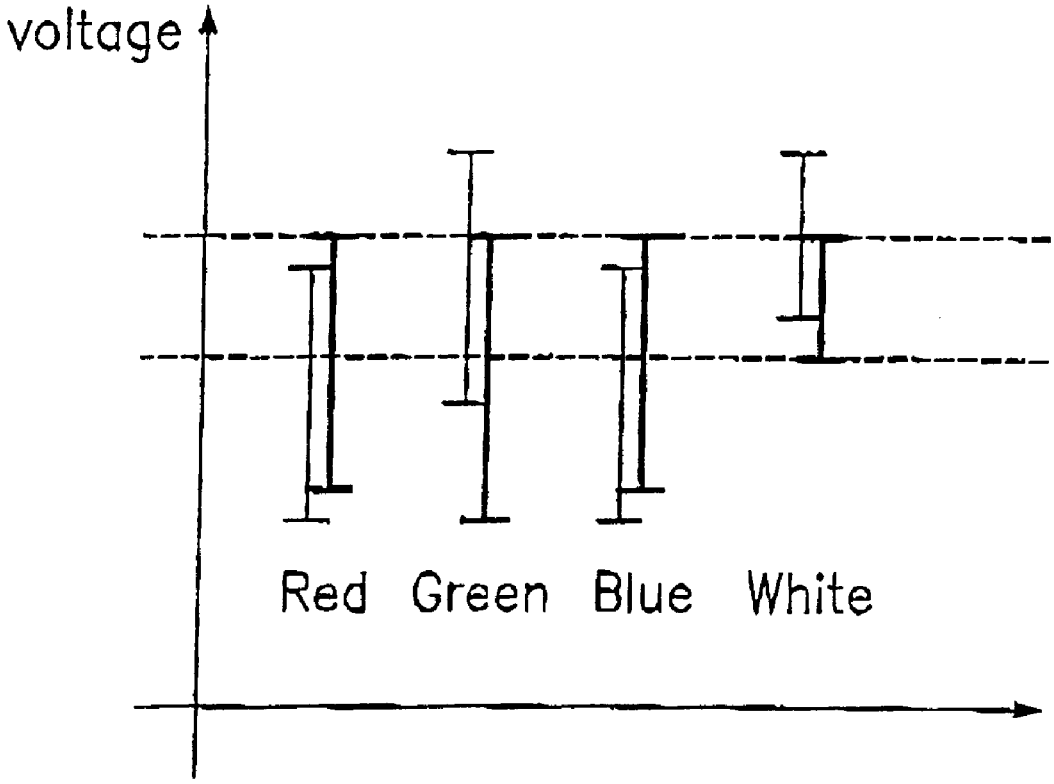
FIG. 13 is a graph showing control range of an aging voltage applied during fabricating the plasma display panel according to the first to sixth embodiments of the present invention.

In the aforementioned plasma display panel according to the first to sixth embodiments of the present invention, emission rate of the green phosphor increases. Thus, as shown in FIG. 13, the aging voltage in the green phosphor is lowered at the same level as the red and blue phosphors.

Finally, the aforementioned plasma display panel according to the first to sixth embodiments of the present invention has the following advantages.

Since more charge particles are generated in the discharge cell having the green phosphor than the discharge cell having the other phosphor unlike the related plasma display panel, the discharge voltage of the discharge cell having the green phosphor can be maintained at a similar level to the discharge voltage of the discharge cell having the other phosphor. As a result, the aging voltage of the discharge cell having the green phosphor becomes lower, thereby reducing the probability to destroy insulation of the dielectric.

Furthermore, since the deviation between the aging voltages for emitting each discharge cell is reduced, a minimum value of the margin voltage stably showing white color becomes lower and a white colored voltage margin which is a common region of red, green, blue and white voltage regions increases, thereby broadening the control range of the circuit.

It will be apparent to those skilled in the art that various modifications and variations can be made in the plasma display device according to the present invention without departing from the spirit or scope of the invention. Thus, it is intended that the present invention covers the modifications and variations of the invention provided they come within the scope of the appended claims and their equivalents.

What is claimed is:

1. A plasma display panel comprising:

an address electrode formed in each discharge cell where a red phosphor, a green phosphor and a blue phosphor are formed; and a sustain electrode formed to cross the address electrode, having a first thickness in a discharge cell having the red phosphor, a second thickness in a discharge cell having the green phosphor, and a third thickness in a discharge cell having the blue phosphor, wherein the second thickness is larger than the first thickness and the third thickness.

2. The plasma display panel as claimed in claim 1, wherein the largest thickness is approximately 1.25 times the smallest thickness.

3. The plasma display panel as claimed in claim 1, wherein the first thickness and the third thickness are the same.

4. A plasma display panel comprising:

an address electrode formed in each discharge cell where a red phosphor, a green phosphor and a blue phosphor are formed;

a pair of sustain electrodes formed in each discharge cell to cross the address electrode; and a projection portion formed in some portion of only each sustain electrode corresponding to the discharge cell having the green phosphor.

5. The plasma display panel as claimed in claim 4, wherein the projection portion is formed toward the center of a discharge area where the address electrode crosses the sustain electrodes.

6. The plasma display panel as claimed in claim 4, wherein the projection portion formed in the sustain electrodes is formed toward an outer direction of the discharge area where the address electrode crosses the sustain electrodes.

7. The plasma display panel as claimed in claim 4, wherein the projection portion has a projection width within the range of 30% of the overall width of the sustain electrode.

8. A plasma display panel comprising:

a first address electrode formed with a first width in a discharge cell having a red phosphor;

a second address electrode formed with a second width in a discharge cell having a blue phosphor; and a third address electrode formed with a third width wider than the first width and the second width in a discharge cell having a green phosphor.

9. The plasma display panel as claimed in claim 8, wherein the first width and the second width are the same sizes as each other.

10. A plasma display panel comprising:

a first address electrode formed with a first width in a discharge cell having a red phosphor;

a second address electrode formed with a second width in a discharge cell having a blue phosphor;

a line formed with a third width in a discharge cell having a green phosphor; and a plurality of third address electrodes formed with a fourth width wider than the third width on some portion of the line at certain intervals.

11. A plasma display panel comprising:

an address electrode respectively formed in each discharge cell having a red phosphor, a green phosphor and a blue phosphor; and a dielectric film deposited on the address electrode, having a first thickness in a discharge cell having the red phosphor, a second thickness in a discharge cell having the green phosphor, and a third thickness in a discharge cell having the blue phosphor, wherein the second thickness is different than the first thickness, and wherein the second thickness is different than the third thickness.

12. The plasma display panel as claimed in claim 11, wherein the first thickness and the third thickness are the same sizes as each other.

13. The plasma display panel as claimed in claim 11, wherein the second thickness has the smallest value.

14. A plasma display panel comprising:

an address electrode respectively formed in each discharge cell having a red phosphor, a green phosphor and a blue phosphor on a predetermined lower substrate;

a first dielectric film deposited on the address electrode on the lower substrate; and a second dielectric film formed on only the first dielectric film formed on the address electrode of the discharge cell where the red phosphor and the blue phosphor are formed.

15. A plasma display panel comprising:

a first isolation wall formed between a first address electrode in a discharge cell having a red phosphor and a second address electrode in a discharge cell having a blue phosphor;

a second isolation wall formed between a third address electrode in a discharge cell having a green phosphor and the first address electrode at a first interval from the first isolation wall; and a third isolation wall formed between a fourth address electrode next to the third address electrode and the third address electrode at a second interval greater than the first interval from the second isolation wall, wherein the first isolation wall, the second isolation wall, and the third isolation wall are substantially parallel.

16. The plasma display panel as claimed in claim 15, wherein a ratio of the first interval and the second interval is within the range of 0.5:1.0 to 0.9:1.0.

17. A plasma display panel comprising:

a first isolation wall separating a first address electrode in a first discharge cell having a red phosphor and a second address electrode in a second discharge cell having a blue phosphor, wherein the first isolation wall is substantially straight;

a second isolation wall separating a third address electrode in a third discharge cell having a green phosphor and the first address electrode, wherein the second isolation wall is zig zagged; and a third isolation wall formed between a fourth address electrode next to the third address electrode and the third address electrode.

18. The plasma display panel as claimed in claim 17, wherein the third isolation wall is zig zagged.

19. The plasma display panel as claimed in claim 17, wherein the third isolation wall is linear-symmetrical to the second isolation wall.

20. The plasma display panel as claimed in claim 17, wherein an average distance between the second isolation wall and the third isolation wall is greater than an average distance between the first isolation wall the second isolation wall.

21. A plasma display panel comprising:

a first cell configured to discharge green light, including a first sustain electrode; and a second cell configured to discharge at least one of red light and blue light, including a second sustain electrode, wherein the width of the first sustain electrode is larger than the width of the second sustain electrode.

22. A plasma display panel comprising:

a first cell configured to discharge light at a first wavelength, including a first address electrode; and a second cell configured to discharge light at a second wavelength, including a second address electrode, wherein the thickness of the first address electrode is larger than the thickness of the second address electrode.

23. The plasma display panel of claim 22, wherein the light at the first wavelength is green light.

24. The plasma display panel of claim 22, wherein the light at the second wavelength is at least one of red and blue.

25. The plasma display panel of claim 22, further includes a third cell configured to discharge light at a third wavelength, wherein the third cell includes a third address electrode, and wherein the width of the first address electrode is larger than the width of the third address electrode.

26. A plasma display panel comprising:

a first cell configured to discharge light at a first wavelength, including a first address electrode and a first dielectric film; and a second cell configured to discharge light at a second wavelength, including a second address electrode and a second dielectric film, wherein the thickness of the first dielectric film is smaller than the thickness of the second dielectric film.

27. The plasma display panel of claim 26, wherein the light at the first wavelength is green light.

28. The plasma display panel of claim 26, wherein the light at the second wavelength is at least one of red and blue.

29. The plasma display panel of claim 26, further comprising a third cell configured to discharge light at a third wavelength, wherein the third cell includes a third address electrode and a third dielectric film, and wherein the thickness of the first dielectric film is smaller than the thickness of the third dielectric film.

30. The plasma display panel of claim 29, wherein the third dielectric film and the second dielectric film are the same thickness.

31. A plasma display panel comprising:

a first cell configured to discharge green light, wherein a first area of the first cell is defined by two isolation walls; and a second cell configured to discharge at least one of red light and blue light, wherein a second area of the second cell is defined by two isolation walls, and wherein the first area is larger than the second area.

32. A plasma display panel comprising:

a first cell configured to discharge light at a first wavelength, wherein the first cell is confined by a first isolation wall and a second isolation wall;

a second cell configured to discharge light at a second wavelength, wherein the second cell is confined by the second isolation wall and a third isolation wall;

a third cell configured to discharge light at a third wavelength, wherein the third cell is confined by the third isolation wall and a fourth isolation wall, wherein the first isolation wall and the fourth isolation wall are substantially parallel, wherein the second isolation wall and the third isolation wall are zig zagged.

33. The plasma display panel of claim 32, wherein the light at the second wavelength is green light.

34. The plasma display panel of claim 32, wherein the light at the first wavelength is red and the light at the third wavelength is blue.

35. The plasma display panel of claim 32, wherein the second cell is larger than both the first cell and the third cell.

36. The plasma display panel of claim 32, wherein the second isolation wall is linearly symmetrical to the third isolation wall.

37. The plasma display panel of claim 32, wherein the average distance between the second isolation wall and the third isolation wall is greater than the average distance between the first isolation wall and the third isolation wall.

38. The plasma display panel of claim 32, wherein the average distance between the second isolation wall and the third isolation wall is greater than the average distance between the third isolation wall and the fourth isolation wall.

* * * * *

US006630788C1

(12) EX PARTE REEXAMINATION CERTIFICATE (7860th)

United States Patent

Park

(10) Number: US 6,630,788 C1

(45) Certificate Issued: Nov. 9, 2010

(54) PLASMA DISPLAY PANEL

(75) Inventor: Hun Gun Park, Kyongsangbuk-do (KR)

(73) Assignee: LG Electronics Inc., Youngdungpo-gu, Seoul (KR)

Reexamination Request:
No. 90/010,234, Aug. 1, 2008

Reexamination Certificate for:

| | |
|---|---|
| Patent No.: | **6,630,788** |
| Issued: | **Oct. 7, 2003** |
| Appl. No.: | **09/570,284** |
| Filed: | **May 12, 2000** |

(30) Foreign Application Priority Data

| | | |
|---|---|---|
| May 14, 1999 | (KR) | 1999/17393 |
| May 14, 1999 | (KR) | 1999/17421 |
| May 14, 1999 | (KR) | 1999/17422 |
| May 14, 1999 | (KR) | 1999/17423 |

(51) Int. Cl.
*H01J 17/49* (2006.01)

(52) U.S. Cl. ..... 313/582; 313/584

(58) Field of Classification Search ..... None
See application file for complete search history.

(56) References Cited

FOREIGN PATENT DOCUMENTS

JP 06-44907 2/1994

*Primary Examiner*—Anjan K. Deb

(57) ABSTRACT

A plasma display panel includes an address electrode formed in each discharge cell where a red phosphor, a green phosphor and a blue phosphor are formed, and a sustain electrode formed to cross the address electrode, having a first width in a discharge cell having the red phosphor, a second width in a discharge cell having the green phosphor, and a third width in a discharge cell having the blue phosphor. Since an aging voltage of the discharge cell having the green phosphor becomes lower by varying the sustain electrode, the address electrode, a dielectric film or an isolation wall, the probability to destroy insulation of the dielectric is reduced. Also, since the deviation between the aging voltages for emitting each discharge cell is reduced, a minimum value of the margin voltage stably showing white color becomes lower and a white colored voltage margin which is a common region of red, green, blue and white voltage regions increases, thereby broadening the control range of a circuit.

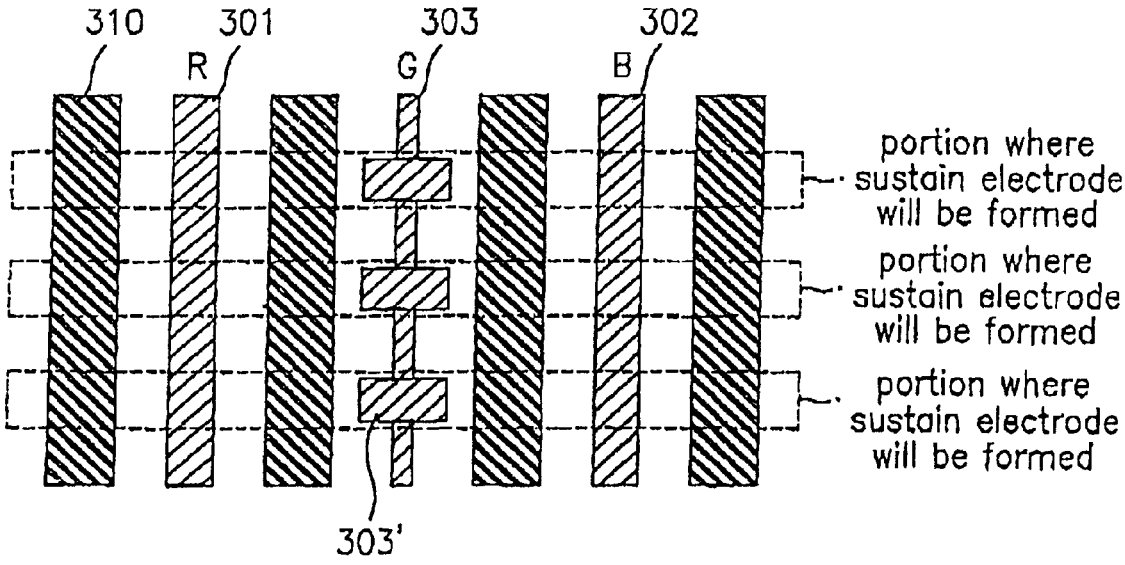

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 10 is cancelled.

New claims 39-44 are added and determined to be patentable.

Claims 1-9 and 11-38 were not reexamined.

*39. The plasma display panel of claim 15, wherein a fourth isolation wall is formed between a fifth address electrode next to the second address electrode and the second address electrode at a third interval from the first isolation wall.*

*40. The plasma display panel of claim 39, wherein the third interval is substantially the same as the first interval.*

*41. A plasma display panel comprising:*

*a plurality of first address electrodes, each formed with a first width in a discharge cell having a red phosphor;*

*a plurality of second address electrodes, each formed with a second width in a discharge cell having a blue phosphor;*

*a plurality of third address electrodes, each formed in a discharge cell having a green phosphor and having a line with a third width and some portions of the line at certain intervals having a fourth width, which wider than the third width; wherein*

*one of the first address electrodes is provided between first and second isolation walls which are separated from each other by a first prescribed distance, and*

*one of the third address electrodes is provided between the second isolation wall and a third isolation wall, which are separated from each other by a second prescribed distance, and*

*the first prescribed distance is less than the second prescribed distance.*

*42. The plasma display panel of claim 41, wherein one of the second address electrodes is provided between the third isolation wall and a fourth isolation wall, which are separated from each other by a third prescribed distance.*

*43. The plasma display panel of claim 42, wherein the third prescribed distance is less than the second prescribed distance.*

*44. The plasma display panel of claim 43, wherein the first prescribed distance and the third prescribed distance are substantially the same.*

* * * * *